US007036328B2

(12) United States Patent
Shin

(10) Patent No.: US 7,036,328 B2
(45) Date of Patent: May 2, 2006

(54) AIR CONDITIONER

(75) Inventor: Jeong Soo Shin, Suwon (KR)

(73) Assignee: Samsung Electronics Co., Ltd., Kyungki-Do (KR)

( * ) Notice: Subject to any disclaimer, the term of this patent is extended or adjusted under 35 U.S.C. 154(b) by 0 days.

(21) Appl. No.: 10/855,321

(22) Filed: May 28, 2004

(65) Prior Publication Data

US 2005/0050911 A1 Mar. 10, 2005

(30) Foreign Application Priority Data

Sep. 9, 2003 (KR) ..... 10-2003-0063000

(51) Int. Cl.
*F25B 1/00* (2006.01)

(52) U.S. Cl. ..... 62/115; 62/296; 181/207

(58) Field of Classification Search ..... 62/160, 62/324.6, 296, 527, 115; 181/196, 207
See application file for complete search history.

(56) References Cited

U.S. PATENT DOCUMENTS 3,788,093 A * 1/1974 Lauterbach ..... 62/200
4,437,317 A * 3/1984 Ibrahim ..... 62/81
4,457,138 A * 7/1984 Bowman ..... 62/196.1
4,774,815 A * 10/1988 Schlosser ..... 62/149
4,831,835 A * 5/1989 Beehler et al. ..... 62/196.1
5,586,443 A * 12/1996 Lewis ..... 62/115
5,605,058 A * 2/1997 Kurachi et al. ..... 62/503
5,875,638 A * 3/1999 Tinsler ..... 62/149
6,216,817 B1 * 4/2001 Kannon et al. ..... 181/296
6,539,745 B1 * 4/2003 Harmer et al. ..... 62/503
6,615,597 B1 * 9/2003 Domyo et al. ..... 62/197
6,666,042 B1 * 12/2003 Cline et al. ..... 62/175

FOREIGN PATENT DOCUMENTS

JP 2000-257916 A * 9/2000
KR 2002024880 A * 4/2002
KR 2002087801 A * 11/2002
KR 2002-96659 A 12/2002

* cited by examiner

*Primary Examiner*—Mohammad M. Ali
(74) *Attorney, Agent, or Firm*—Sughrue Mion, PLLC

(57) ABSTRACT

An air conditioner which includes a plurality of indoor units to cool air of a plurality of rooms. Included is a plurality of branch refrigerant lines that each include a backflow prevention part provided at an end of the branch refrigerant line and/or a pulsation dampening part provided at an end of the branch refrigerant line, adjacent to the main refrigerant line. The air conditioner acts to prevent a liquid part of the refrigerant from flowing in a reverse direction into idle indoor heat exchangers. Furthermore, because a pressure pulsation of the refrigerant is dampened by the pulsation dampening part before the refrigerant is supplied into the indoor heat exchangers, the air conditioner reduces vibration, and, thus, noise from the indoor heat exchangers which is caused by the pressure pulsation of the refrigerant.

25 Claims, 3 Drawing Sheets

AIR CONDITIONER

CROSS-REFERENCE TO RELATED APPLICATIONS

This application claims the benefit of Korean Patent Application No. 2003-63000, filed Sep. 9, 2003 in the Korean Intellectual Property Office, the disclosures of which are incorporated herein by reference.

BACKGROUND OF THE INVENTION

1. Field of the Invention

Apparatuses and methods consistent with the present invention relate, in general, to air conditioners and, more particularly, to an air conditioner which includes a plurality of indoor units to respectively condition air of a plurality of rooms.

2. Description of the Related Art

Generally, air conditioners are apparatuses utilizing a refrigerating circuit principle so as to cool or heat indoor air. Air conditioners typically include an indoor unit which is placed indoors and an outdoor unit which is placed outdoors, such that heat is transferred between a refrigerant and indoor air at the indoor unit and between the refrigerant and outdoor air at the outdoor unit so as to cool or heat the indoor air.

In the related art, there are multiunit-type air conditioners which include a plurality of indoor units with a plurality of indoor heat exchangers respectively placed in the plurality of indoor units, so as to cool or heat the air of a plurality of rooms by distributing a refrigerant from an outdoor heat exchanger of an outdoor unit to the plurality of indoor heat exchangers of the plurality of indoor units.

When only specific rooms of the plurality of rooms having the multiunit-type air conditioner are specified to be cooled or heated, specific indoor units which correspond to the specific rooms to be cooled or heated are operated. At this time, the conventional multiunit-type air conditioners are problematic in that rooms which are not specified to be cooled or heated are undesirably cooled or heated, because the liquid part contained in the refrigerant, which is discharged from the indoor heat exchangers of the operated indoor units, flows in a reverse direction into idle indoor heat exchangers of the indoor units corresponding to the unspecified rooms.

Furthermore, when a pressure pulsation of the refrigerant, which is caused by a compression by a compressor, is transmitted to the indoor heat exchangers, the conventional multiunit-type air conditioners force the indoor heat exchangers to vibrate, thus becoming noisy due to the pressure pulsation of the refrigerant.

SUMMARY OF THE INVENTION

Illustrative, non-limiting embodiments of the present invention overcome the above disadvantages and other disadvantages not described above. Also, the present invention is not required to overcome the disadvantages described above, and an illustrative, non-limiting embodiment of the present invention may not overcome any of the problems described above.

Accordingly, it is an aspect of the present invention to provide an apparatus and method which prevent unspecified rooms from being undesirably cooled or heated by a liquid refrigerant which flows in a reverse direction into idle indoor heat exchangers of indoor units corresponding to the unspecified rooms.

It is another aspect of the present invention to provide an apparatus and method which reduce vibration, and thus noise from the indoor heat exchangers of the indoor units which are caused by a pressure pulsation of the refrigerant.

Additional aspects and/or advantages of the invention will be set forth in part in the description which follows and, in part, will be obvious from the description, or may be learned by practice of the invention.

In particular, the present invention contemplates an air conditioner, including a compressor to compress a refrigerant, an outdoor heat exchanger placed outdoors, and a plurality of indoor heat exchangers respectively placed in a plurality of rooms to heat or cool the air of the rooms. Also provided is a main refrigerant line to guide the refrigerant so as to circulate the refrigerant through the outdoor heat exchanger and the plurality of indoor heat exchangers, and a plurality of branch refrigerant lines which branch from the main refrigerant line to respectively return the refrigerant from the plurality of indoor heat exchangers to the main refrigerant line. A backflow prevention part is provided at an end of each of the branch refrigerant lines adjacent to the main refrigerant line, such that the backflow prevention part extends upward in relation to the main refrigerant line and is connected at a lower end thereof to the main refrigerant line. The backflow prevention part is also contemplated as extending vertically.

It is also contemplated that an embodiment of the invention includes an air conditioner, including a compressor to compress a refrigerant, an outdoor heat exchanger placed outdoors, and a plurality of indoor heat exchangers respectively placed in a plurality of rooms to heat or cool air of the rooms. Additionally provided is a main refrigerant line to guide the refrigerant so as to circulate the refrigerant through the outdoor heat exchanger and the plurality of indoor heat exchangers, and a plurality of branch refrigerant lines which branch from the main refrigerant line to distribute the refrigerant from the main refrigerant line to the plurality of indoor heat exchangers. A pulsation dampening part is provided at an end of each of the branch refrigerant lines, adjacent to the main refrigerant line, so as to change a flowing direction of the refrigerant passing through the pulsation dampening part, thus dampening a pressure pulsation of the refrigerant. The pressure pulsation is responsible for causing vibration. The pulsation dampening part of each of the branch refrigerant lines may have a bent shape which is bent at a predetermined angle.

It is further contemplated that the present invention provides an air conditioner having a compressor to compress a refrigerant, an outdoor heat exchanger placed outdoors, and a plurality of indoor heat exchangers respectively placed in a plurality of rooms to heat or cool the air of the rooms. A four-way valve is provided at an outlet side of the compressor to control a flowing direction of the refrigerant discharged from the compressor, according to an operational mode of the air conditioner which is selected between a cooling-mode operation and a heating-mode operation. A main refrigerant line guides the refrigerant to circulate the refrigerant through the outdoor heat exchanger and the plurality of indoor heat exchangers. A plurality of branch refrigerant lines branch from the main refrigerant line, with the plurality of indoor heat exchangers respectively mounted on intermediate portions of the branch refrigerant lines so as to distribute the refrigerant from the main refrigerant line to the plurality of indoor heat exchangers, and to return the refrigerant from the plurality of indoor heat exchangers to the main refrigerant line. The plurality of branch refrigerant lines each includes a backflow prevention part provided at an end of the branch refrigerant line adjacent to the main refrigerant line, such that the backflow prevention part extends upward in relation to the main refrigerant line and is connected at a lower end thereof to the main refrigerant line, and a pulsation dampening part provided at the end of the branch refrigerant line, adjacent to the main refrigerant line, so as to change a flowing direction of the refrigerant passing through the pulsation dampening part, thus dampening a pressure pulsation of the refrigerant. The backflow prevention part is also contemplated as extending vertically.

According to a further non-limiting aspect of the invention, provided is backflow prevention means for preventing refrigerant, which has been discharged from at least one of the indoor heat exchangers of an operational unit, from flowing in a reverse direction into at least one of another of the indoor heat exchangers of an idle unit. Additionally, pulsation dampening means may be provided for changing a flow direction of the refrigerant so as to dampen a pressure pulsation of the refrigerant.

It is also contemplated that a method of air conditioning a plurality of rooms is provided. The method includes compressing a refrigerant and guiding the refrigerant to circulate through an outdoor heat exchanger and a plurality of indoor heat exchangers. The refrigerant is returned from the plurality of indoor heat exchangers to a main refrigerant line. Backflow of the refrigerant is prevented from flowing in a reverse direction from at least one of the indoor heat exchangers to another of the indoor heat exchangers, by subjecting the refrigerant to an upward or vertically extending line connected at a lower end thereof to the main refrigerant line.

Even further, a non-limiting method includes guiding the refrigerant to circulate from an outdoor heat exchanger through a main refrigerant line and into branch refrigerant lines which respectively lead to a plurality of indoor heat exchangers. The refrigerant is returned from the plurality of indoor heat exchangers to the main refrigerant line. A pressure pulsation of the refrigerant is dampened by changing a flow direction of the refrigerant at ends of the branch refrigerant lines, at a position adjacent to the main refrigerant line.

BRIEF DESCRIPTION OF THE DRAWINGS

These and/or other aspects and advantages of the invention will become apparent and more readily appreciated from the following description of the exemplary embodiments, taken in conjunction with the accompanying drawings of which.

DETAILED DESCRIPTION OF ILLUSTRATIVE, NON-LIMITING EMBODIMENTS OF THE INVENTION

Figure 1:
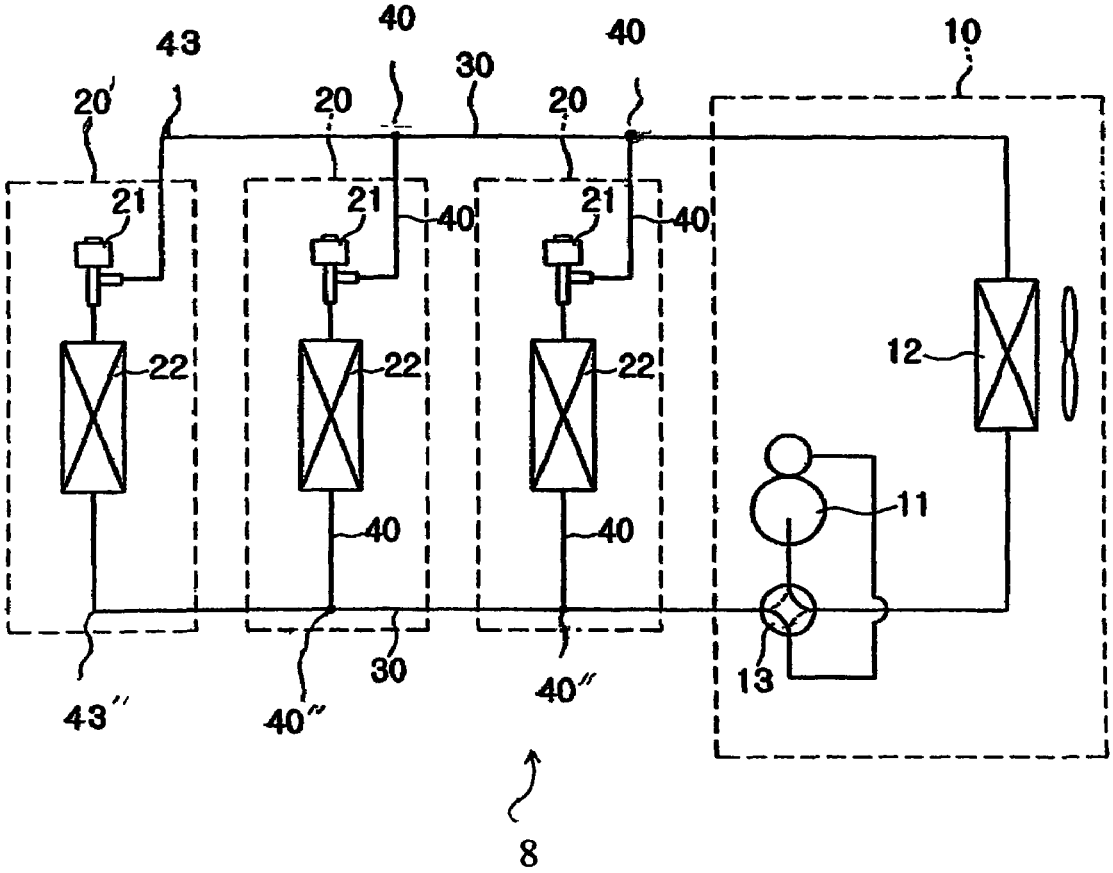
FIG. 1 is a circuit diagram showing a refrigeration circuit of an air conditioner, according to the present invention.

Reference will now be made in detail to embodiments of the present invention, examples of which are illustrated in the accompanying drawings, wherein like reference numerals refer to like elements throughout. The embodiments are described below in order to explain the present invention by referring to the figures.

As shown in FIG. 1, an air conditioner 8 of the present invention, which is a multiunit-type air conditioner, includes an outdoor unit 10 which is placed outdoors and a plurality of indoor units 20 which are respectively placed in a plurality of rooms. The indoor units 20 thus cool or heat the indoor air of the plurality of rooms selectively and independently by a refrigerant which is distributed into the plurality of indoor units 20.

The multiunit-type air conditioner 8 further includes a compressor 11 and an outdoor heat exchanger 12 in the outdoor unit 10. The compressor 11 compresses the low-temperature, low-pressure refrigerant to provide the high-temperature, high-pressure refrigerant. The outdoor heat exchanger 12 executes a heat transfer between the refrigerant and outdoor air. The plurality of indoor units each has an expansion valve 21, which expand the refrigerant to allow the refrigerant to effectively transfer heat, and an indoor heat exchanger 22, which executes a heat transfer between the refrigerant and indoor air. Therefore, during operation of the air conditioner, either the outdoor heat exchanger 12 or the indoor heat exchangers 22 are used as evaporators, and the remaining heat exchanger or exchangers are used as condensers, according to an operational mode of the air conditioner which is selected between a cooling-mode operation to cool the rooms and a heating-mode operation to heat the rooms.

The above-mentioned parts of a refrigerant circuit are connected to each other by a plurality of refrigerant pipes 30 and 40 to form a closed circuit. The refrigerant circulates through the refrigerant pipes 30 and 40 to pass through the parts of the refrigerant circuit, thus cooling or heating the indoor air of the rooms. The air conditioner 8 further includes a four-way valve 13 which is provided on the refrigerant pipe 30 at an outlet side of the compressor 11 to control a flowing direction of the refrigerant discharged from the compressor 11, according to the operational mode of the air conditioner which is selected between the cooling-mode operation and the heating-mode operation.

The refrigerant pipes 30 and 40 comprise a main refrigerant pipe 30, which guides the refrigerant so as to circulate the refrigerant through the outdoor heat exchanger 12 and the plurality of indoor heat exchangers 22, and a plurality of branch refrigerant pipes 40 which branch from the main refrigerant pipe 30 to distribute the refrigerant into the plurality of indoor heat exchangers 22 and, simultaneously, to return the refrigerant from the plurality of indoor heat exchangers 22 to the main refrigerant pipe 30. At this time, the plurality of indoor heat exchangers 22 are respectively provided on intermediate portions of the plurality of the branch refrigerant pipes 40. The plurality of the branch refrigerant pipes 40 branch from the main refrigerant pipe 30 at a same height from a support surface, so that the refrigerant is evenly distributed into the plurality of indoor heat exchangers 22. In first and second non-limiting, illustrative embodiments of the present invention, for ease of description, a part of each of the branch refrigerant pipes 40, which guides the refrigerant into each of the indoor heat exchangers 22, is so-called a distributing part of the branch refrigerant pipe 40. A remaining part of each of the branch refrigerant pipes 40, which returns the refrigerant from the indoor heat exchanger 22 to the main refrigerant pipe 30, is so-called a returning part of the branch refrigerant pipe 40. As shown in FIG. 1, the main refrigerant pipe 30 may be connected to an indoor heat exchanger 22 and an expansion valve 21 of an indoor unit 20' without utilizing a separate branch refrigerant pipe 40. This is because the indoor unit 20' is at an end of a series of indoor units. However, it will be appreciated that the indoor unit 20' can utilize the aspects of the invention in the same manner as the other indoor units 20.

Figure 2:
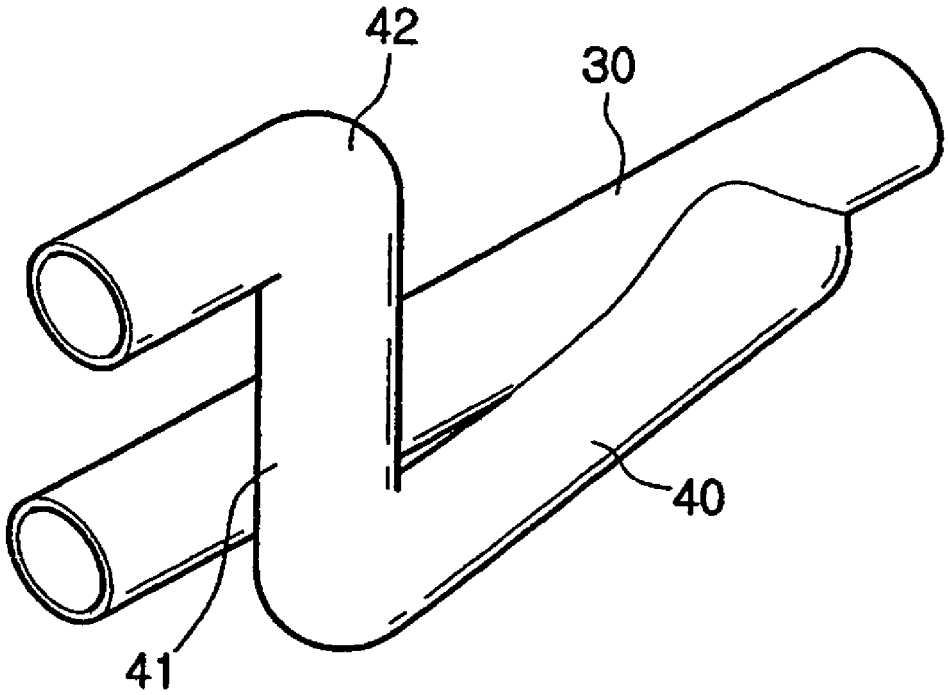
FIG. 2 is a perspective view of a main refrigerant pipe and a branch refrigerant pipe of an air conditioner, according to a first non-limiting embodiment of the present invention.

In the first embodiment of the present invention, as shown in FIG. 2, a backflow prevention part or backflow prevention means 41 is provided at one or both ends 40' and 40" (shown in FIG. 1) of each of the branch refrigerant pipes 40 so as to prevent a liquid refrigerant from flowing in a reverse direction from the main refrigerant pipe 30 into an idle indoor heat exchanger 22 corresponding to the branch refrigerant pipe 40. A pulsation dampening part or pulsation dampening means 42 is provided at one or both ends 40' and 40" of each of the branch refrigerant pipes 40 so as to dampen a pressure pulsation of the refrigerant by changing a flowing direction of the refrigerant passing through the pulsation dampening part 42. Because the main refrigerant pipe 30 may be disposed to flow directly into the indoor unit 20', the backflow prevention part 41 and the pulsation dampening part 42 may be, for example, located at the positions 43' and 43". Such positions of the backflow prevention parts 41 and pulsation dampening parts 42 are given merely as examples. As will be appreciated, the backflow prevention parts 41 and the pulsation dampening parts 42 may be positioned at other areas of the air conditioner system so as to achieve the desired results.

The backflow prevention part 41 extends upward in relation to the main refrigerant line and, in an illustrative embodiment, is positioned vertically. The backflow prevention part 41 is connected at a lower end thereof to the main refrigerant pipe 30. Generally, the liquid refrigerant flows from a higher position to a lower position due to gravity. Therefore, when the backflow prevention part 41 extends vertically, as described above, the liquid refrigerant cannot flow in the reverse direction from the lower end of the backflow prevention part 41 to an upper end of the backflow prevention part 41. Therefore, the liquid refrigerant cannot flow in the reverse direction from the main refrigerant pipe 30 into the idle indoor heat exchanger 22.

The pulsation dampening part 42 has a bent shape which is bent at a predetermined angle so as to change the flowing direction of the refrigerant. In the first embodiment of the present invention, the pulsation dampening part 42 is bent to form a right angle. Accordingly, the refrigerant, which flows through the pulsation dampening part 42, forcibly contacts with an inner surface of the pulsation dampening part 42. The pulsation dampening part 42 of each of the branch refrigerant pipes 40, thug, dampens the pressure pulsation of the refrigerant which passes through the branch refrigerant pipe 40 and reduces vibration. Due to the above-mentioned construction of the pulsation dampening parts 42, the pressure pulsation, which may be transmitted to the indoor heat exchangers 22 provided in the indoor units 20, is reduced. Accordingly, the air conditioner 8 of the present invention reduces vibration, and noise from the indoor heat exchangers 22 caused by the pressure pulsation.

Figure 3:
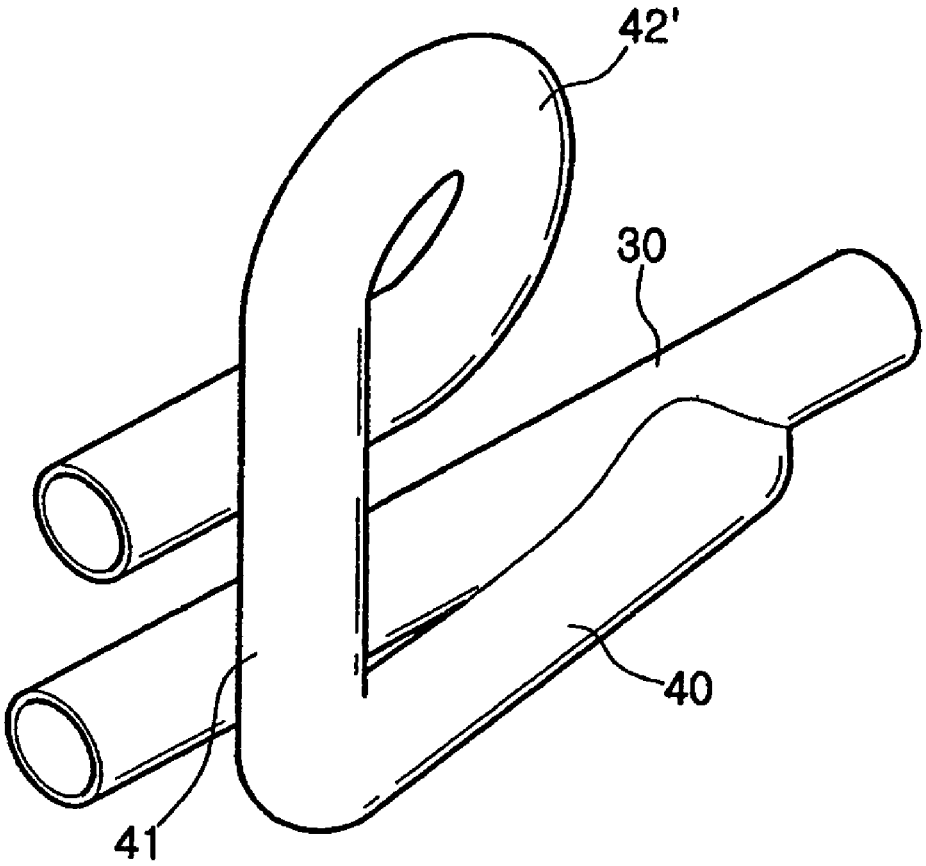
FIG. 3 is a perspective view of a main refrigerant pipe and a branch refrigerant pipe of an air conditioner, according to a second non-limiting embodiment of the present invention.

As noted above, the pulsation dampening part 42 is bent at a right angle in the first embodiment of the present invention. However, to dampen an excessively high pressure pulsation of the refrigerant, each of the branch refrigerant pipes 40 may have a pulsation dampening part 42' with a bent shape which is bent at an angle of, for example, 270 degrees, as shown in FIG. 3, which shows the second embodiment of the present invention. Alternatively, the bent angle of the pulsation dampening part 42 may be controlled according to the intensity of the pressure pulsation, such that an ability of the pulsation dampening part 42 to dampen the pressure pulsation is controlled.

The air conditioner of each of the first and second embodiments of the present invention changes flowing direction of the discharged refrigerant using the four-way valve 13, so as to execute either the cooling-mode operation or the heating-mode operation. Therefore, the distributing and returning parts may be reversed, according to the operational mode of the air conditioner selected between the cooling-mode operation and the heating-mode operation. In the first and second embodiments of the present invention, the backflow prevention part 41 and the pulsation dampening part 42 are provided at each of the both ends of each of the branch refrigerant pipes 40. However, without being limited to the first and second embodiments of the present invention, the pulsation dampening part 42 and 42' may be provided at only the distributing part of each of the branch refrigerant pipes 40 and the backflow prevention part 41 may be provided at only the returning part of each of the branch refrigerant pipes 40, in the case of an air conditioner which executes only the cooling-mode operation.

Next, the operation and effect of the air conditioner of the present invention will be described herein below.

When cooling indoor air of the rooms, the refrigerant discharged from the compressor 11 is cooled while passing through the outdoor heat exchanger 12. Then, the cooled refrigerant is distributed into the plurality of the indoor heat exchangers 22 after passing through the main refrigerant pipe 30 and the distributing parts of the plurality of branch refrigerant pipes 40. At this time, the pressure pulsation of the refrigerant is caused by a suction, compression, and a discharging operation of the compressor 11. However, the pulsation dampening parts 42 respectively provided at the branch refrigerant pipes 40 dampen the pressure pulsation of the refrigerant.

In particular, because the pulsation dampening parts 42 quickly and severely change the flowing direction of the refrigerant, the refrigerant forcibly contacts with the inner surfaces of the pulsation dampening parts 42. Accordingly, the pulsation dampening parts 42 of the branch refrigerant pipes 40 dampen the pressure pulsation of the refrigerant and reduces vibration. The pressure pulsation of the refrigerant is, thus, dampened by the pulsation dampening parts 42.

The refrigerant, which passes through the plurality of indoor heat exchangers 22, returns to the main refrigerant pipe 30 through the returning parts of the plurality of branch refrigerant pipes 40. At this time, when operation of only some of the indoor units 20 is desired, the backflow prevention parts 41 corresponding to idle indoor units 20 prevent the liquid refrigerant, which has been discharged from the indoor heat exchangers 22 of the operating indoor units 20, from flowing in the reverse direction into the indoor heat exchangers 22 of the idle indoor units 20.

That is, because the liquid part, which is contained in the refrigerant that has been discharged from the operating indoor heat exchangers 22 to the main refrigerant pipe 30, flows downward due to gravity, the liquid part of the refrigerant cannot flow in the reverse direction due to an operation of the backflow prevention parts 41, which extend vertically. The backflow prevention parts 41, thus, prevent the liquid part of the refrigerant from flowing into the idle indoor heat exchangers 22.

As apparent from the above description, in an air conditioner of the present invention, because a backflow prevention part provided at each of branch refrigerant pipes prevents a liquid part of a refrigerant from flowing in a reverse direction into an idle indoor heat exchanger, indoor units provided in rooms which are not specified to be cooled or heated are free from a heat transfer between indoor air and the refrigerant.

Furthermore, a pressure pulsation of the refrigerant is dampened by a pulsation dampening part which is provided at each of the branch refrigerant pipes, before the refrigerant is supplied into the indoor heat exchangers. Therefore, the air conditioner of the present invention reduces vibration, and, thus, noise from the indoor heat exchangers which are caused by the pressure pulsation of the refrigerant.

Although a few illustrative embodiments of the present invention have been shown and described, it would be appreciated by those skilled in the art that changes may be made in these exemplary embodiments without departing from the principles and spirit of the invention, the scope of which is defined in the claims and their equivalents.

What is claimed is:

1. An air conditioner, comprising:

a compressor to compress a refrigerant;

an outdoor heat exchanger;

a plurality of indoor heat exchangers;

a main refrigerant line to guide the refrigerant so as to circulate the refrigerant through the outdoor heat exchanger and the plurality of indoor heat exchangers;

a plurality of branch refrigerant lines which branch from the main refrigerant line to respectively return the refrigerant from the plurality of indoor heat exchangers to the main refrigerant line; and a backflow prevention part provided at an end of each of the branch refrigerant lines, such that the backflow prevention part extends upward in relation to the main refrigerant line and is connected at a lower end thereof to the main refrigerant line.

2. The air conditioner according to claim 1, wherein the plurality of indoor heat exchangers are respectively placed in a plurality of rooms to at least one of heat and cool air of the rooms.

3. The air conditioner according to claim 1, wherein the backflow prevention part is provided at an end of each of the branch refrigerant lines adjacent to the main refrigerant line.

4. The air conditioner according to claim 1, wherein the backflow prevention part extends upward vertically.

5. An air conditioner, comprising:

a compressor to compress a refrigerant;

an outdoor heat exchanger;

a plurality of indoor heat exchangers;

a main refrigerant line to guide the refrigerant so as to circulate the refrigerant through the outdoor heat exchanger and the plurality of indoor heat exchangers;

a plurality of branch refrigerant lines which branch from the main refrigerant line to respectively distribute the refrigerant from the main refrigerant line to the plurality of indoor heat exchangers; and a pulsation dampening part provided at an end of each of the branch refrigerant lines, so as to change a flowing direction of the refrigerant passing through the pulsation dampening part, thus dampening a pressure pulsation of the refrigerant, wherein the pressure pulsation causes vibration.

6. The air conditioner according to claim 5, wherein the pulsation dampening part of the branch refrigerant line has a bent shape which is bent at a predetermined angle.

7. The air conditioner according to claim 5, wherein the plurality of indoor heat exchangers are respectively placed in a plurality of rooms to at least one of heat and cool air of the rooms.

8. The air conditioner according to claim 5, wherein the pulsation dampening part is provided at an end of each of the branch refrigerant lines adjacent to the main refrigerant line.

9. An air conditioner, comprising:

a compressor to compress a refrigerant;

an outdoor heat exchanger;

a plurality of indoor heat exchangers;

a four-way valve provided at an outlet side of the compressor to control a flowing direction of the refrigerant discharged from the compressor, according to an operational mode of the air conditioner selected between a cooling-mode operation and a heating-mode operation;

a main refrigerant line to guide the refrigerant so as to circulate the refrigerant through the outdoor heat exchanger and the plurality of indoor heat exchangers; and a plurality of branch refrigerant lines which branch from the main refrigerant line, the plurality of indoor heat exchangers being respectively mounted on intermediate portions of the branch refrigerant lines so as to distribute the refrigerant from the main refrigerant line to the plurality of indoor heat exchangers, and to return the refrigerant from the plurality of indoor heat exchangers to the main refrigerant line, the plurality of branch refrigerant lines each comprising;

a backflow prevention part provided at an end of each of the branch refrigerant lines adjacent to the main refrigerant line, such that the backflow prevention part extends upward in relation to the main refrigerant line and is connected at a lower end thereof to the main refrigerant line; and a pulsation dampening part provided at the end of each of the branch refrigerant lines adjacent to the main refrigerant line, which changes a flowing direction of the refrigerant passing through the pulsation dampening part, so as to dampen a pressure pulsation of the refrigerant, wherein the pressure pulsation causes vibration.

10. The air conditioner according to claim 9, wherein the plurality of indoor heat exchangers are respectively placed in a plurality of rooms to at least one of heat and cool air of the rooms.

11. The air conditioner according to claim 9, wherein the backflow prevention part extends upward vertically.

12. An air conditioner, comprising:

a compressor to compress a refrigerant;

an outdoor heat exchanger;

a plurality of indoor heat exchangers;

a main refrigerant line to guide the refrigerant so as to circulate the refrigerant through the outdoor heat exchanger and the plurality of indoor heat exchangers;

a plurality of branch refrigerant lines which branch from the main refrigerant line to respectively return the refrigerant from the plurality of indoor heat exchangers to the main refrigerant line; and backflow prevention means for preventing refrigerant, which has been discharged from at least one of the indoor heat exchangers of an operational unit, from flowing in a reverse direction into at least one of another of the indoor heat exchangers of an idle unit.

13. The air conditioner according to claim 12, wherein the plurality of indoor heat exchangers are respectively placed in a plurality of rooms to at least one of heat and cool air of the rooms.

14. The air conditioner according to claim 12, wherein the backflow prevention means is provided at an end of each of the branch refrigerant lines adjacent to the main refrigerant line.

15. The air conditioner according to claim 12, wherein the backflow prevention means includes a part which extends upward in relation to the main refrigerant line and is connected at a lower end thereof to the main refrigerant line.

16. The air conditioner according to claim 12, wherein the backflow prevention means extends upward vertically.

17. An air conditioner, comprising:

a compressor to compress a refrigerant;

an outdoor heat exchanger;

a plurality of indoor heat exchangers;

a main refrigerant line to guide the refrigerant so as to circulate the refrigerant through the outdoor heat exchanger and the plurality of indoor heat exchangers;

a plurality of branch refrigerant lines which branch from the main refrigerant line to respectively distribute the refrigerant from the main refrigerant line to the plurality of indoor heat exchangers; and pulsation dampening means, provided at the end of each of the branch refrigerant lines, for changing a flow direction of the refrigerant so as to dampen a pressure pulsation of the refrigerant.

18. The air conditioner according to claim 17, wherein the plurality of indoor heat exchangers are respectively placed in a plurality of rooms to at least one of heat and cool air of the rooms.

19. The air conditioner according to claim 17, wherein the pulsation dampening means is provided at an end of each of the branch refrigerant lines adjacent to the main refrigerant line.

20. The air conditioner according to claim 17, wherein the pulsation dampening means has a bent shape which is bent at a predetermined angle.

21. An air conditioner, comprising:

a compressor to compress a refrigerant;

an outdoor heat exchanger;

a plurality of indoor heat exchangers;

a four-way valve provided at an outlet side of the compressor to control a flowing direction of the refrigerant discharged from the compressor, according to an operational mode of the air conditioner selected between a cooling-mode operation and a heating-mode operation;

a main refrigerant line to guide the refrigerant to circulate the refrigerant through the outdoor heat exchanger and the plurality of indoor heat exchangers; and a plurality of branch refrigerant lines which branch from the main refrigerant line, with the plurality of indoor heat exchangers respectively mounted on intermediate portions of the branch refrigerant lines so as to distribute the refrigerant from the main refrigerant line to the plurality of indoor heat exchangers, and to return the refrigerant from the plurality of indoor heat exchangers to the main refrigerant line, the plurality of branch refrigerant lines each comprising, backflow prevention means for preventing refrigerant, which has been discharged from at least one of the indoor heat exchangers of an operational unit, from flowing in a reverse direction into at least one of another of the indoor heat exchangers of an idle unit; and a pulsation dampening means for changing a flow direction of the refrigerant passing through the pulsation dampening part so as to dampen a pressure pulsation of the refrigerant.

22. The air conditioner according to claim 21, wherein the backflow prevention means and the pulsation dampening means are provided at an end of each of the branch refrigerant lines adjacent to the main refrigerant line.

23. The air conditioner according to claim 21, wherein the backflow prevention means includes a part which extends upward in relation to the main refrigerant line and is connected at a lower end thereof to the main refrigerant line.

24. A method of air conditioning a plurality of rooms, comprising:

compressing a refrigerant;

guiding the refrigerant to circulate through an outdoor heat exchanger and a plurality of indoor heat exchangers;

returning the refrigerant from the plurality of indoor heat exchangers to a main refrigerant line; and preventing backflow of refrigerant from flowing in a reverse direction from at least one of the indoor heat exchangers to another of the indoor heat exchangers by subjecting the refrigerant to an upward extending line connected at a lower end thereof to the main refrigerant line.

25. A method of air conditioning a plurality of rooms, comprising:

compressing a refrigerant;

guiding the refrigerant to circulate from an outdoor heat exchanger through a main refrigerant line and into branch refrigerant lines which respectively lead to a plurality of indoor heat exchangers;

returning the refrigerant from the plurality of indoor heat exchangers to the main refrigerant line; and dampening a pressure pulsation of the refrigerant by changing a flow direction of the refrigerant at ends of the branch refrigerant lines at a position adjacent to the main refrigerant line.

* * * * *